US005445335A

United States Patent [19]

Hallmann et al.

[11] Patent Number: 5,445,335

[45] Date of Patent: Aug. 29, 1995

[54] COIL CARRIER COMPRESSIBLE IN AXIAL DIRECTION

[75] Inventors: Franz Hallmann, Würselen; Albert Keusch, Übach-Palenberg, both of Germany

[73] Assignee: Jos. Zimmermann GmbH & Co. KG, Aachen, Germany

[21] Appl. No.: 78,982

[22] Filed: Jun. 16, 1993

[30] Foreign Application Priority Data

Jun. 17, 1992 [DE] Germany ..... 42 19 844.5

[51] Int. Cl.[6] ..... B65H 75/20

[52] U.S. Cl. ..... 242/118.1; 242/118.11

[58] Field of Search ..... 242/118.1, 118.11, 578.3; 68/189, 198

[56] References Cited

U.S. PATENT DOCUMENTS 4,941,621 7/1990 Pasini ..... 242/118.1
4,986,488 1/1991 Windhösel ..... 242/118.1
5,152,475 10/1992 Pasini ..... 242/118.1

*Primary Examiner*—John M. Jillions
*Attorney, Agent, or Firm*—David C. Purdue; John C. Purdue

[57] ABSTRACT

A coil carrier compressible in axial direction, for the heat and wet treatment of threads and yarns, with a cylindrical or fruits-shaped winding surface, incorporates carrier rings (1;26) whose cross-sections are tapered radially outwards, and which are configured coaxially to one another. Neighbouring carrier rings (1;26) are joined together by struts (9;16;27). Facing limiting stops (11,12;20;28;29) are provided on the facing surfaces of neighbouring carrier rings (1;26), whereby the faces (13,14;21) of these limiting stops are oriented in radial direction normal to the axis of the coil carrier. The faces (13, 14;21) interlock directly or, alternatively, each face acts together with one functional surface (18,19) of an intermediate element (17) installed between the limiting stops. (FIG. 1)

33 Claims, 5 Drawing Sheets

COIL CARRIER COMPRESSIBLE IN AXIAL DIRECTION

DESCRIPTION

Figure 1:
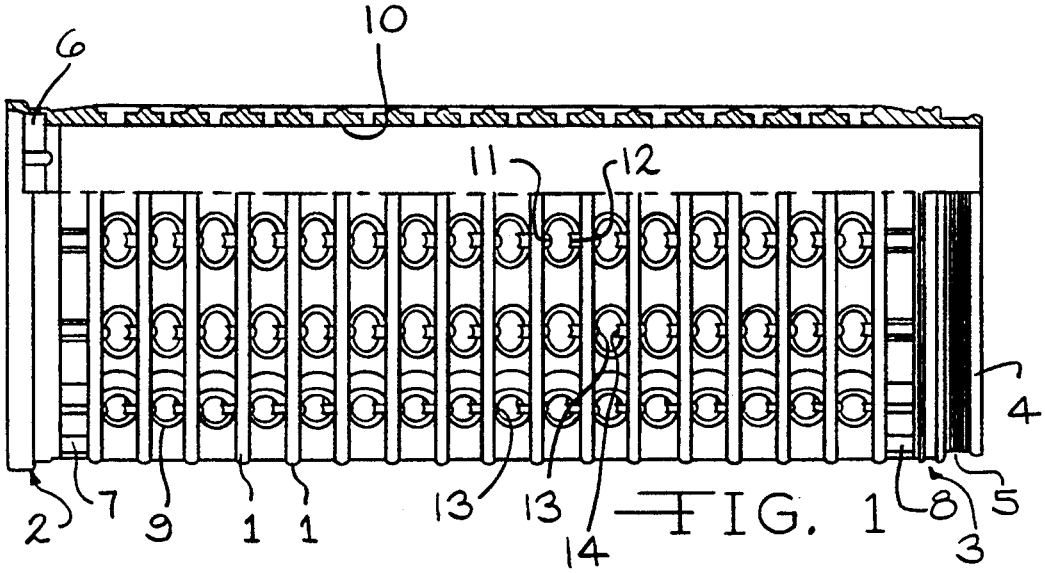

The invention concerns a coil carrier compressible in axial direction, for the heat and/or wet treatment of threads and yarns, with a cylindrical or frustum-shaped casing forming a winding surface, said surface being determined by coaxially configured carrier rings whose cross-sections are tapered radially outwards, said rings being joined together by struts between each pair of neighbouring carrier rings.

U.S. Pat. No. 4,941,621 describes such a coil carrier whose carrier rings are tapered radially outwards. This known coil Is carrier incorporates bar-shaped limiting elements, one end of which is joined to a carrier ring to form a single piece, while the other end presses against an inclined surface of the neighbouring ring when the coil carrier is compressed. This configuration is intended to enable the maximum compression level to be determined precisely.

However, pressing a limiting element against an inclined surface in this manner means that the effective compressive force is subject to a radial component in the direction of the inclination of the cross-section of the carrier rings. As a result, the limiting element slips on the carrier ring and the coil carrier sags out at this point. This, in turn, leads to deviations from the maximum defined compression level, as a result of which the desired reproducibility and homogeneity of compression is often unattainable.

Such a coil carrier can be provided with end rings at each end which thrust together or interlock. In the case of interlocking end rings, the outer diameter of the interlocking collar of one end ring can be matched with the outer diameter of the receiver of the other end ring so as to enable a thread reserve to be accommodated on the collar. For this purpose, a thread reserve groove can also be installed on the collar.

The object of this invention is to configure a coil carrier of the type mentioned at the beginning of this description in such a manner as to eliminate radial displacements of the parts which come into contact with one another in the course of compression, without this impairing the demoulding properties of such a coil carrier.

The present invention attains this objective with a coil carrier of the type mentioned at the beginning of this description by virtue of the fact that facing limiting stops are provided on the facing surfaces of neighbouring carrier rings, the faces of said limiting stops being held by imaginary radial lines running normal to the axis of the coil carrier, whereby the faces fit together directly or each face fits against one functional surface of an intermediate element located between two limiting stops.

Towards the end of the compression process, only the faces of the limiting stops act together, either directly or via the functional surfaces of an intermediate element. None of these surfaces are inclined in radial direction, and the manner in which they interlock prevents them from becoming displaced in circumferential direction. This reliably prevents any relative movements of the engaged parts. The number and total surface area of the faces and functional surfaces are small in relation to the total surface area of the flanks of the carrier rings, as a result of which they have practically no effect on demoulding properties. The limiting stops, which become active only towards the end of the compression process, have only a correspondingly low level of axial extension, which enables them to be produced in dimensionally stable design, which additionally helps to prevent undesired deformations.

The invented coil carrier can further be configured in such a manner that the faces of the limiting stops and the functional surfaces of the intermediate elements are arched convexly or concavely around a radial line running centrically to the limiting stops and intermediate elements. This ensures reliable interlocking and insertion.

The invented coil carrier can further be configured in such a manner that the radius of the convex arch is greater than that of the concave arch. This enhances the stability of the interlock between the surfaces which act together.

The invented coil carrier can further be configured in such a manner that the carrier rings are rigid and the struts are flexible.

The invented coil carrier can further be configured in such a manner that the struts are inclined towards a surface line running parallel to the axis, and that an intermediate element is attached to the middle area of each strut. As the struts are deformed, the intermediate element moves into the interlocking area of the limiting stops. The individual working parts here can be produced in very small configurations, as only in combination are they are required to keep the desired gap open at maximum compression.

The invented coil carrier can further be configured in such a manner that each intermediate element has two convex functional surfaces, each of which is designed to fit a concave face of a limiting stop. The intermediate element then interlocks with the faces of two limiting stops and is securely fixed in these stops.

The invented coil carrier can further be configured in such a manner that the carrier rings are flexible in axial direction and the struts are configured as rigid, axially aligned supports and are spaced equidistantly in circumferential direction, whereby the struts acting on either side of a carrier ring are displaced in relation to one another by one half spacing and the limiting stops are each located in the centre between two struts when viewed in circumferential direction.

The invented coil carrier can further be configured in such a manner that the radial extension of the faces and of the functional surfaces is less than that of the carrier rings. As a result, the interaction between the faces and functional surfaces takes place not in the winding surface, but is displaced radially inwards. This ensures that a gap is maintained at all times in the area of the winding surface between neighbouring carrier rings, thereby preventing threads or yarns from jamming.

The invented coil carrier can further be configured in such a manner that the radial extension of the carrier rings is identical to that of the struts. This enlarges the overall supporting surface for the coil, thereby reducing the surface pressure on the yarn coil, which is of relevance to some applications.

Finally, the invented coil carrier can be configured in such a manner that the faces, the functional surfaces, the struts and the carrier rings are located on a common inner enveloping surface. This considerably simplifies the design of the core which is required for the moulding die.

The following part of the description describes several embodiments of the coil carrier in accordance with the present invention, by reference to drawings.

Figure 2:
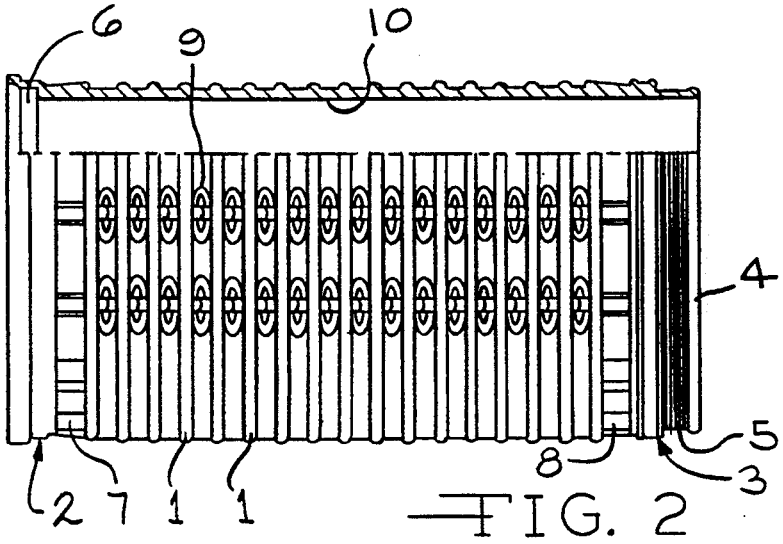
Figure 3:
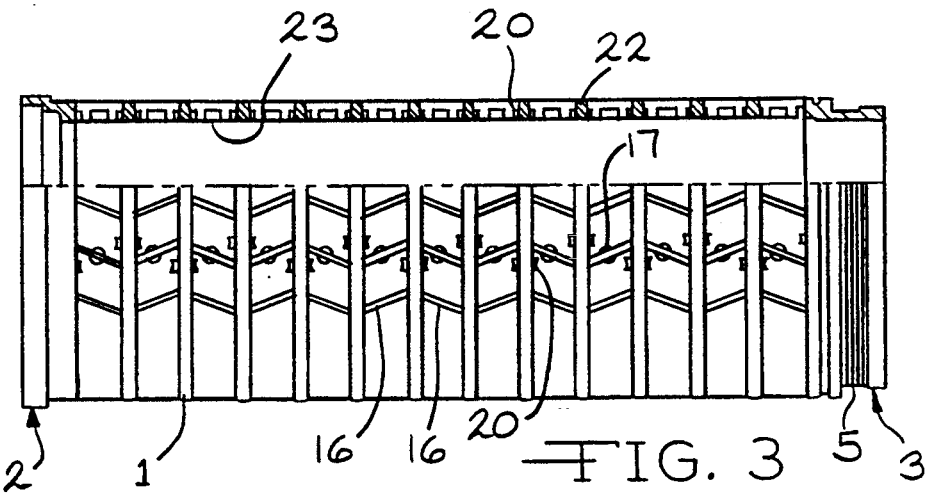
Figure 4:
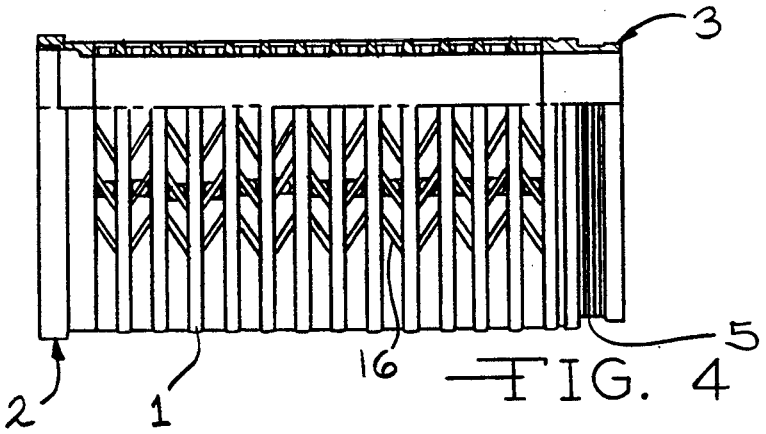
Figure 5:
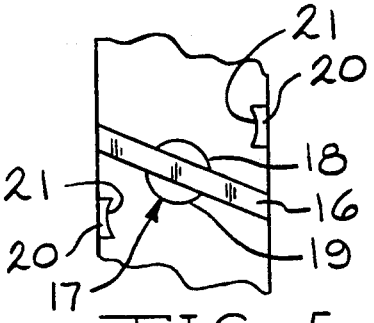
Figure 6:
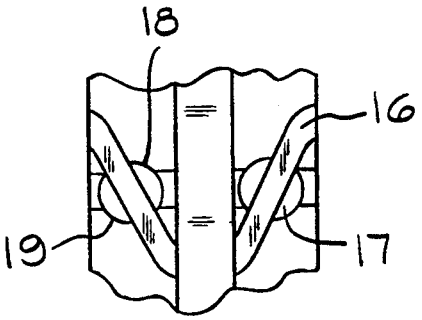
Figure 7:
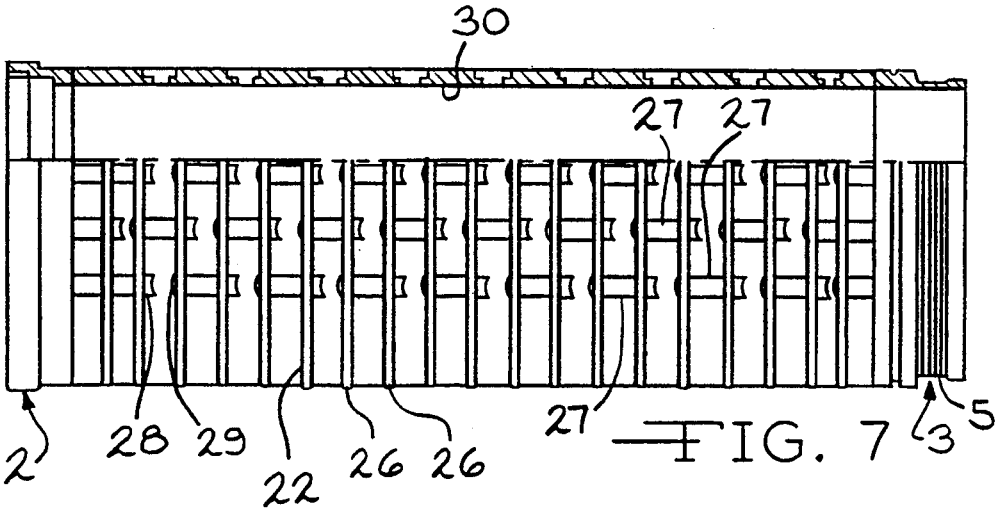
Figure 8:
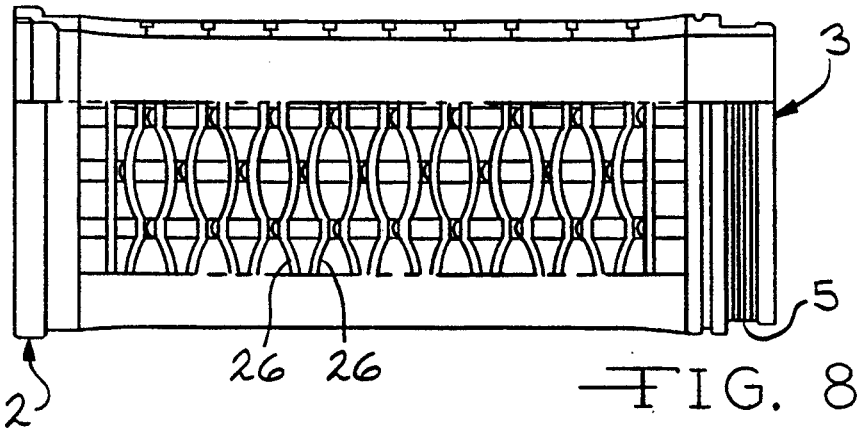
Figure 9:
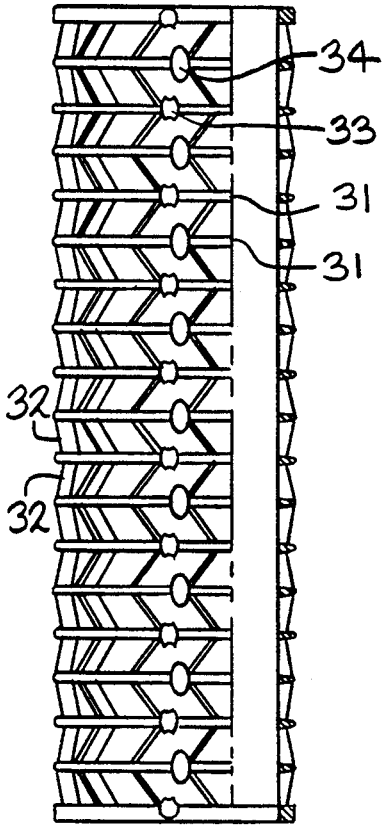
Figure 10:
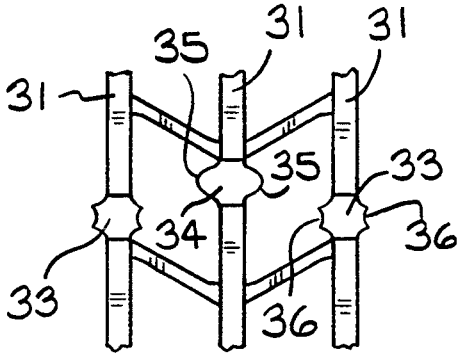
Figure 11:
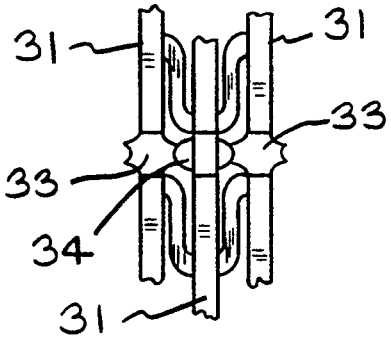
Figure 12:
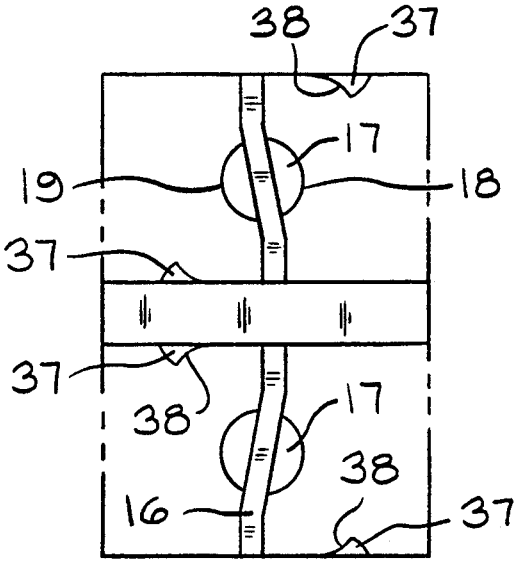
Figure 13:
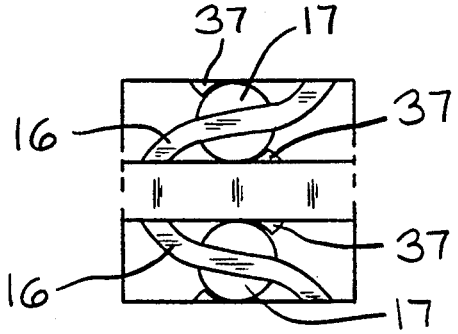

FIG. 1 shows a side view, partly in sectional form, of an initial embodiment of the invented coil carrier, with rigid carrier rings and the directly interlocking faces of limiting stops, in non-compressed state FIG. 2 shows the coil carrier presented in FIG. 1 in a view corresponding to that shown in FIG. 1, in compressed state FIG. 3 shows a side view, partly in sectional form, of a further embodiment of the invented coil carrier with rigid carrier rings and intermediate elements in non-compressed state FIG. 4 shows the coil carrier presented in FIG. 3 in a view corresponding to that shown in FIG. 3, in compressed state FIG. 5 shows a detail of an intermediate element on a strut in non-compressed state FIG. 6 shows a detail concerning the position of the intermediate elements in compressed state FIG. 7 shows a side view, partly in sectional form, of a further embodiment of the invented coil carrier with flexible carrier rings and rigid struts in non-compressed state FIG. 8 shows the coil carrier presented in FIG. 7 in a view corresponding to that shown in FIG. 7, in compressed state FIG. 9 shows a side view, partly in sectional form, of a further embodiment of the invented coil carrier, whereby neighbouring carrier rings are joined by struts inclined towards a surface line FIG. 10 shows a detail of the embodiment presented in FIG. 9, in non-compressed state FIG. 11 shows a view corresponding to the detail presented in FIG. 10, in compressed state FIG. 12 shows a partial view of a further embodiment, with intermediate elements located on a strut and a half-shell limiting stop in non-compressed state, and FIG. 13 shows a view corresponding to that represented in FIG. 12, in compressed state.

The coil carrier in accordance with the embodiments shown in FIGS. 1 and 2 has parallel coaxial carrier rings, 1, and two end rings, 2, 3. End ring 3 has a collar, 4, with a thread reserve groove, 5. The collar, 4, fits into a receiver, 6, on the other end ring, 2, of a neighbouring, identical coil carrier employed in the heat or wet treatment process.

The end rings, 2, 3, are each joined to the nearest carrier ring, 1, via axial support struts, 7, 8.

Arch-shaped struts, 9, are located between each of the carrier rings, 1. Each pair of facing struts, 9, is designed to produce a circular or tubular configuration. The carrier rings, 1, and the struts, 9, have the same radial thickness. These elements jointly form the casing of the coil carrier and are thus located on a common inner enveloping surface, 10.

The struts, 9, are spaced equidistantly over the circumference of the coil carrier.

Limiting stops, 11, 12, are provided on each carrier ring, 1, between each pair of struts, 9, which form a circular or tubular configuration, said limiting stops, 11, 12, projecting from the respective carrier rings, 1, towards the neighbouring carrier ring, 1, in axial direction and being aligned with a limiting stop installed on this neighbouring carrier ring, 1. Limiting stops 11 have a convex face, 13, while limiting stops 12 have a concave face, 14. When the coil carrier is compressed, the faces, 13, 14, fit together, whereby the concave face, 14, overlaps the convex face, 13. The curvature of the two faces, 13, 14, is such that a gentle clamping action occurs when the two faces, 13, 14, come together. The faces, 13, 14, have no inclination in radial direction, which means that the compressive forces cannot be split into radial force components when faces 13 and 14 interlock.

FIG. 2 shows the interlocking process for the limiting stops, 11, 12, and the deformation of the struts, 9.

The embodiment presented in FIGS. 3 to 6 has two end rings, 2, 3, similarly to the above-described embodiment. This embodiment also incorporates carrier rings, 1, in the above-described manner. In this embodiment, neighbouring carrier rings, 1, are joined together by struts, 16, which are inclined in the same direction and spaced equidistantly around the circumference, whereby the struts, 16, on the respective sides of each carrier ring, 1, are inclined in opposite directions.

Some of the struts, 16, are provided with discoid intermediate elements, 17, with cylindrical circumferences. These intermediate elements are located in the middle area of the struts, 16, and each form two functional surfaces, 18, 19, as is shown particularly clearly in FIGS. 5 and 6. On the facing surfaces of neighbouring carrier rings, 1, there are identical limiting stops, 20, each of which has a concave face, 21.

When the coil carrier is subjected to axial compression, the struts, 16, are deformed as shown in FIGS. 4, 6. As a result of this compression, the intermediate elements, 17, are also displaced, until the functional surfaces, 18, of the intermediate elements, 17, finally interlock with the faces, 21, of the limiting stops, 20, and prevent any further compression. The interfunctional surfaces are oriented normal to the axis of the coil carrier, as a result of which no radially outward or radially inward inclination occurs, which means that no radial force components can be diverted from the compressive force.

The top part of FIG. 3 shows the cross-section of the carrier rings, 1, with inclined flanks, 22, to which the limiting stops, 20, are attached.

Carrier rings, 1, struts, 16, functional surfaces, 18, 19, and limiting stops, 20, emanate from a common inner enveloping surface, 23, whereby only the carrier rings, 1, and the struts, 16, protrude together into one and the same outer casing.

The embodiment shown in FIGS. 7, 8, incorporates end rings, 2, 3, in the above-described manner. Carrier rings, 26, are also installed in parallel and concentric configuration between the end rings, 2, 3. These carrier rings, 26, are flexible when axial pressure is exerted.

Between each two neighbouring carrier rings, 26, there are several axial struts, 27, spaced equidistantly around the circumference, whereby the two struts which act on the respective sides of each carrier ring, 26, are displaced in relation to one another by one half spacing.

At that point on the flanks, 22, of each carrier ring, at which a strut, 27, is provided on one side of the carrier ring, 26, a limiting stop, 28, 29, is provided on the other side of the same carrier ring, 26. The two limiting stops, 28, 29, face one another, whereby one stop has a concave face while the other has a convex face.

When axial compression occurs, the flow of forces causes the carrier rings, 26, to be moved together via the struts, 27, at the point at which two limiting stops, 28, 29, face one another. These limiting stops, 28, 29, eventually interlock, thereby defining the maximum compression distance.

In this embodiment, too, the interacting faces are oriented normal to the axis of the coil carrier, again preventing a radial force component to be diverted from the compressive force and thus preventing radial deformation.

Carrier rings, 26, struts, 27, and limiting stops, 28, 29, emanate from the same inner enveloping surface, 30. The radial extension of the limiting stops, 28, 29, is less than that of the carrier rings, 26, and the supports, 27. This prevents the carrier rings, 26, from coming too closely together at maximum compression and thus causing jamming.

Thermoplastic plastic is particularly suitable for manufacturing the coil carrier in accordance with the present invention in its various embodiments, whereby any desired colour of plastic can be selected.

In the embodiment shown in FIGS. 9 to 11, neighbouring carrier rings, 31, are joined by struts, 32, which are configured at an inclined angle to a surface line running parallel to the axis of the coil carrier in such a manner that the inclination of the struts on one side of a carrier ring, 31, is an exact reflection of the inclination of the struts, 32, on the other side of this carrier ring. In this respect, the embodiment shown in FIG. 9 essentially corresponds to the embodiment shown in FIGS. 3–6.

In this case, however, limiting stops, 33, 34, are provided on both sides of each carrier ring, 31. When the coil carrier is in non-compressed state, the limiting stops, 33, 34, of neighbouring end rings, 31 , are displaced in relation to one another in circumferential direction. When the coil carrier in accordance with FIG. 9 is compressed, neighbouring carrier rings are turned relative to one another around the axis of the coil carrier. The displacement between the limiting stops of neighbouring carrier rings, 31, corresponds to the torsion which occurs at maximum compression of the coil carrier.

As shown in FIG. 10, limiting stops 34 have two facing convex faces, 35, while limiting stops 33 have two facing concave faces, 36, with which the convex faces, 35, interlock in compressed state, thereby exactly defining the maximum compression of the coil carrier, as illustrated in FIG. 11.

In this embodiment, the faces, 35, 36, again have no inclination in radial direction. They may be regarded as being held by radial lines running normal to the axis of the coil carrier.

The embodiment shown in FIGS. 12, 13 largely corresponds to that shown in FIGS. 3 to 6. The same reference numbers are thus employed. The sole difference in the embodiment shown in FIGS. 12, 13 is that limiting stops, 37, are provided on the carrier rings, the faces, 38, of which extend from their point closest to the carrier ring, 1, in one circumferential direction only. This simplified configuration for the limiting stops, 37, is sufficient when compression automatically displaces the intermediate element, 17, in one direction, as is the case when it is installed on inclined struts, 16.

Here again, the faces are not inclined in radial direction, and can thus be regarded as being held by radial lines running normal to the axis of the coil carrier.

We claim:

1. An axially compressible carrier for supporting threads or yams, said carrier having a winding surface with a cylindrical or frustum shape, said carrier comprising a pair of end rings, a plurality of carrier rings having first and second sides, said carrier rings being positioned and supported between said end rings, struts connected to said first and second sides of said carrier rings and connecting said carrier rings to adjacent ones of said carrier rings, first facing limiting stops provided on said carrier rings, each of said first facing limiting stops having a facing surface, second facing limiting stops provided on said carrier rings, each of said second limiting stops having a facing surface, said first and second facing limiting stops being so configured, positioned and supported on said carrier rings that said facing surfaces thereof are operable, when the carrier is compressed in an axial direction, to engage facing surfaces on adjacent carrier rings, are operable to prevent further compression and, when so engaged, are operable to prevent relative movement between adjacent carrier rings.

2. The carrier claimed in claim 1 wherein said facing surfaces of said first limiting stops are arched convexly and wherein said facing surfaces of said second limiting stops are arched concavely.

3. The carrier claimed in claim 2 wherein the radius of the convex arch is greater than the radius of the concave arch.

4. The carrier claimed in claim 1 wherein said carrier rings are rigid and said struts are flexible.

5. The carrier claimed in claim 2 wherein said carrier rings are rigid and said struts are flexible.

6. The carrier claimed in claim 3 wherein said carrier rings are rigid and said struts are flexible.

7. The carrier claimed in claim 1 wherein said struts are rigid and axially aligned, wherein said struts on said first side of each of said carrier rings are spaced equidistantly from each other about the circumference of the carrier, wherein said struts on said second side of each of said rings are spaced equidistantly from each other about the circumference of the carrier, wherein said struts on said left side of said carrier ring are staggered by one half spacing relative to said struts on said right side of said carrier ring and vice-versa, and wherein, when said carrier is fully compressed, said first and second limiting stops are centered between two struts.

8. The carrier claimed in claim 2 wherein said struts are rigid and axially aligned, wherein said struts on said first side of each of said carrier rings are spaced equidistantly from each other about the circumference of the carrier, wherein said struts on said second side of each of said rings are spaced equidistantly from each other about the circumference of the carrier, wherein said struts on said left side of said cartier ring are staggered by one half spacing relative to said struts on said right side of said carrier ring and vice-versa, and wherein, when said carrier is fully compressed, said first and second limiting stops are centered between two struts.

9. The carrier claimed in claim 3 wherein said struts are rigid and axially aligned, wherein said struts on said first side of each of said carrier rings are spaced equidistantly from each other about the circumference of the carrier, wherein said struts on said second side of each of said rings are spaced equidistantly from each other about the circumference of the cartier, wherein said struts on said left side of said carrier ring are staggered by one half spacing relative to said struts on said tight side of said carrier ring and vice-versa, and wherein, when said carrier is fully compressed, said first and second limiting stops are centered between two struts.

10. An axially compressible carrier for supporting threads or yams, said carrier having a winding surface with a cylindrical or frustrum shape, said cartier comprising a pair of end rings, a plurality of carrier rings having first and second sides, said carrier rings being positioned and supported between said ends rings, struts connected to said first and second sides of said carrier rings and connecting said carrier rings to adjacent ones of said carrier rings, first facing limiting stops provided on said carrier rings, each of said first facing limiting stops having a facing surface, second facing limiting stops provided on said cartier rings, each of said second limiting stops having a facing surface, intermediate elements supported between said carrier rings, each of said intermediate elements having first and second functional surfaces which are operable, when the carrier is compressed, to engage a facing surface of a first limiting stop on an adjacent carrier ring and a facing surface of a second limiting stop of another adjacent carrier ring, said first and second facing limiting stops and said intermediate elements being so configured, positioned and supported on said carrier rings that they are operable, when said first and second functional surfaces of said intermediate elements engage a facing surface of a first limiting stop on an adjacent carrier ring and a facing surface of a second limiting stop of another adjacent carrier ring, to prevent further compression and, when so engaged, to prevent relative movement between adjacent carrier rings.

11. The carrier claimed in claim 10 wherein said functional surfaces of said intermediate element are arched convexly and wherein said facing surfaces of said first and second limiting stops are arched concavely.

12. The carrier claimed in claim 11 wherein the radius of the convex arch is greater than the radius of the concave arch.

13. The carrier claimed in claim 11 wherein said carrier rings are rigid and said struts are flexible.

14. The carrier claimed in claim 12 wherein said carrier rings are rigid and said struts are flexible.

15. The carrier claimed in claim 13 wherein said carrier rings are rigid and said struts are flexible.

16. The carrier claimed in claim 13 wherein said struts do not extend in the direction of the axis of the carrier and each of said intermediate elements is supported on one of said struts, near its middle.

17. The carrier claimed in claim 14 wherein said struts do not extend in the direction of the axis of the carrier and each of said intermediate elements is supported on one of said struts, near its middle.

18. The carrier claimed in claim 16 wherein said struts do not extend in the direction of the axis of the carrier and each of said intermediate elements is supported on one of said struts, near its middle.

19. An axially compressible carrier for supporting threads or yams, said carrier having a winding surface with a cylindrical or frustrum shape, said carrier comprising a pair of end rings, a plurality of carrier rings having first and second sides, said carrier rings being positioned and supported between said ends rings, struts connected to said first and second sides of said carrier rings and connecting said carrier rings to adjacent ones of said carrier rings, first facing limiting stops provided on said carrier rings, each of said first facing limiting stops having a facing surface, second facing limiting stops provided on said carrier rings, each of said second limiting stops having a facing surface, intermediate elements supported between said carrier rings, each of said intermediate elements having first and second functional surfaces which are operable, when the carrier is compressed, to engage a facing surface of a first limiting stop on an adjacent carrier ring and a facing surface of a second limiting stop of another adjacent carrier ring, said first and second facing limiting stops, said struts and said intermediate elements being so configured, positioned and supported on said carrier rings that they are operable, when said first and second functional surfaces of said intermediate elements engage a facing surface of a first limiting stop on an adjacent carrier ring and a facing surface of a second limiting stop of another adjacent carrier ring, to prevent further compression and, when so engaged, to prevent relative movement between adjacent carrier rings.

20. The coil carrier claimed in any one of claims 1 through 9, characterized in that the radial extension of said facing surfaces of said first and second facing limiting stops is less than that of said carrier rings.

21. The coil carrier claimed in any one of claims 10 through 19, characterized in that the radial extension of said facing surfaces of said first and second facing limiting stops and of said functional surfaces of said intermediate elements is less than that of said carrier rings.

22. The coil carrier claimed in any one of claims 1 through 9, characterized in that the radial extension of said carrier rings is identical to that of said struts.

23. The coil carrier claimed in any one of claims 10 through 19, characterized in that the radial extension of said carrier rings is identical to that of said struts.

24. The coil carrier claimed in claim 20, characterized in that the radial extension of said carrier rings is identical to that of said struts.

25. The coil carrier claimed in claim 21, characterized in that the radial extension of said carrier rings is identical to that of said struts.

26. The coil carrier claimed in any one of claims 1 through 9, characterized in that said facing surfaces of said first and second facing limiting stops, said struts and said carrier rings are located on a common inner enveloping surface.

27. The coil carrier claimed in any one of claims 10 through 19, characterized in that said facing surfaces of said first and second facing limiting stops, said functional surfaces of said intermediate elements, said struts and said carrier rings are located on a common inner enveloping surface.

28. The coil carrier claimed in claim 20, characterized in that said facing surfaces of said first and second facing limiting stops, said struts and said carrier rings are located on a common inner enveloping surface.

29. The coil carrier claimed in claim 21, characterized in that said facing surfaces of said first and second facing limiting stops, said functional surfaces of said intermediate elements, said struts and said carrier rings are located on a common inner enveloping surface.

30. The coil carrier claimed in claim 22, characterized in that said facing surfaces of said first and second facing limiting stops, said struts and said carrier rings are located on a common inner enveloping surface.

31. The coil carrier claimed in claim 23, characterized in that said facing surfaces of said first and second facing limiting stops, said functional surfaces of said intermediate elements, said struts and said carrier rings are located on a common inner enveloping surface.

32. The coil carrier claimed in claim 24, characterized in that said facing surfaces of said first and second facing limiting stops, said struts and said carrier rings are located on a common inner enveloping surface.

33. The coil carrier claimed in claim 25, characterized in that said facing surfaces of said first and second facing limiting stops, said functional surfaces of said intermediate elements, said struts and said carrier rings are located on a common inner enveloping surface.

* * * * *

UNITED STATES PATENT AND TRADEMARK OFFICE

CERTIFICATE OF CORRECTION

PATENT NO. : 5,445,335

DATED : Aug. 29, 1995

INVENTOR(S) : Hallmann et al.

It is certified that error appears in the above-identified patent and that said Letters Patent is hereby corrected as shown below:

Title page, item [57], col. 2,
In the Abstract, line 3 should read
cylindrical or frustum-shaped winding surface, incorpo- Column 1, line 16 should read
known coil carrier incorporates bar-shaped limiting Column 6, line 57 should read
struts on said left side of said carrier ring are staggered Column 7, line 2 should read
by one half spacing relative to said struts on said right Column 7, line 20 should read
second facing limiting stops provided on said carrier Signed and Sealed this Ninth Day of April, 1996

Bruce Lehman

*Attest:*

BRUCE LEHMAN

*Attesting Officer*

*Commissioner of Patents and Trademarks*